US006053320A

United States Patent [19]

Kuethe

[11] Patent Number: 6,053,320

[45] **Date of Patent: *Apr. 25, 2000**

[54] MULTIPLE PACKAGE GANGING BAND AND BLANK THEREFOR

[75] Inventor: David F. Kuethe, Waunakee, Wis.

[73] Assignee: Kraft Foods, Inc., Madison, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 09/010,260

[22] Filed: Jan. 21, 1998

[51] Int. Cl.[7] ..... B65D 73/00

[52] U.S. Cl. ..... 206/462; 206/223; 206/820; 426/112; 426/115

[58] Field of Search ..... 206/460, 461–463, 206/486, 470, 531, 532, 538, 539, 557, 558, 775, 779, 813, 216, 223, 820; 426/112, 115

[56] References Cited

U.S. PATENT DOCUMENTS

| | | | |
|---|---|---|---|
| D. 257,001 | 9/1980 | Oliff . | |
| 2,058,648 | 10/1936 | Wellman . | |
| 2,850,160 | 9/1958 | Siebel et al. . | |
| 3,161,288 | 12/1964 | Wagner . | |
| 3,184,319 | 5/1965 | Fritsche | 206/462 |
| 3,246,746 | 4/1966 | Holley | 206/486 |
| 3,246,747 | 4/1966 | Blish | 206/462 |
| 3,685,717 | 8/1972 | Seiferth et al. . | |
| 3,724,653 | 4/1973 | Morgese . | |
| 3,868,017 | 2/1975 | Carveth | 206/461 |
| 4,125,190 | 11/1978 | Davie, Jr. et al. | 206/532 |
| 4,180,165 | 12/1979 | Kuchenbecker . | |
| 4,278,693 | 7/1981 | Dingethal et al. | 206/461 |
| 4,549,654 | 10/1985 | Tiesman . | |
| 4,703,856 | 11/1987 | Chaussadas . | |
| 4,785,953 | 11/1988 | Buchholz et al. . | |
| 4,840,275 | 6/1989 | Faiola et al. | 206/462 |
| 5,109,984 | 5/1992 | Romick | 206/531 |
| 5,123,527 | 6/1992 | Hustad . | |
| 5,197,657 | 3/1993 | Cassidy et al. . | |
| 5,242,055 | 9/1993 | Pora | 206/532 |
| 5,323,907 | 6/1994 | Kalvelage | 206/531 |
| 5,497,882 | 3/1996 | Kenyon . | |
| 5,577,614 | 11/1996 | Palmeroni, Jr. et al. . | |

FOREIGN PATENT DOCUMENTS

| | | | |
|---|---|---|---|
| 98830 | 8/1961 | Netherlands | 206/462 |

*Primary Examiner*—Paul T. Sewell
*Assistant Examiner*—Luan K. Bui
*Attorney, Agent, or Firm*—Cook, Alex, McFarron, Manzo, Cummings & Mehler, Ltd.

[57] ABSTRACT

A wrap-around band is provided for ganging together a plurality of individually complete packages. The resulting combination is a unitary product for purchase as a single item. The individually complete packages around which the band wraps have a protruding compartment within which the saleable goods are packaged. Each protruding compartment is not covered by the wrap-around band and is thus fully visible to the potential purchaser prior to purchase. At least two of the individually complete packages can have profiles which are different from each other and still be accommodated by the wrap-around band.

15 Claims, 2 Drawing Sheets

MULTIPLE PACKAGE GANGING BAND AND BLANK THEREFOR

DESCRIPTION

Background of the Invention

The present invention generally relates to a wrap-around band for ganging together a plurality of individually complete packages. More particularly, the band simultaneously wraps around a plurality of packages having a compartment protruding from a base member. openings are provided along the band, and each protruding compartment is positioned through a respective opening in the band when the band is wrapped around the packages. In this manner, most of the protruding compartment is fully visible to consumers for display purposes, while a plurality of individually complete packages are ganged together for sale as a unit, without requiring that the individually complete packages be identical in shape or size. The invention is particularly well suited for ganging together a plurality of sealed bubble packages containing food products such as sliced luncheon meat or cheese.

Multiple-compartment food packages are generally known wherein a single package contains bubble locations for the same or different types of food such as luncheon meats, cheeses and the like. This allows the consumer to purchase larger quantities of product, when compared with single-compartment packages. An example in this regard is Seiferth et al U.S. Pat. No. 3,685,717, incorporated hereinto by reference. It is generally known to have multiple-compartment packages for foods which allow for a variety of different food items within the same salable unit.

With these types of approaches, the consumer often must open all of the compartments, or a single bubble having multiple compartments, when seeking access to a single one of the compartments. This can result in a situation where a previously sealed stack of luncheon meat or the like is put into an unsealed state before the consumer is ready to gain access to that particular stack of sliced meat or the like. Accordingly, there is a need for an approach whereby multiple products, especially multiple stacks of food products, can be sold as a unit, but the consumer can choose to gain access to only one of the stacks at a time.

Additionally, with approaches such as discussed above, the packaging line must be specifically designed to handle a particular multiple-compartment package design and/or limited types and sizes of food products or the like. This can severely limit the variety of food products and package sizes and shapes which can be accommodated by the food processing and packaging line. This can necessitate having to provide multiple food processing and packaging lines or having to design into those lines approaches which allow for the interchanging of different food products, bubble shapes, bubble size or shape combinations, and the like. These latter alternatives are expensive and lead to machinery complexity and potential processing line breakdowns. Accordingly, there is a need for an approach which avoids these limiting aspects and these complicating aspects while still permitting variety in products within saleable unit packaging.

It is also generally known to package multiple products, at times of different sizes and/or configurations, within a single package. Examples in this regard include Tiesman U.S. Pat. No. 4,549,654 and Chaussadas U.S. Pat. No. 4,703,856. Approaches of this type generally obscure much of the products from view prior to purchase by the consumer and/or they seal the products within a specially sized and shaped blister, thereby increasing packaging costs and complexity. Accordingly, there is a need for an approach by which multiple individually complete packages of product are securely joined together to form a unitary saleable unit, without substantially obscuring from view the bubble or protruding portion of the individually complete packages of product.

SUMMARY OF THE INVENTION

In accordance with the present invention, a wrap-around band is provided for ganging together a plurality of individually complete packages into a unitary saleable unit. The wrap-around band, as well as the blank from which it is fashioned, has a front portion having a plurality of openings and a peripheral area surrounding these openings. A back surface, in cooperation with the peripheral area of the front surface, encloses a collar portion of each of the individually complete packages, with the front surface being secured to the back surface such that the collar portion is secured within the wrap-around band. At the same time, a compartment or bubble which protrudes with respect to the collar portion passes through one of the openings through the front portion of the wrap-around band. Each such opening is sized and shaped so as to accommodate a protruding compartment or bubble of one of the individually complete packages. As a result, the wrap-around band encloses the collar portion of each package without covering or significantly obscuring the ability of the consumer to observe the protruding compartment of each package.

It is accordingly a general object of the present invention to provide a new and improved multiple package ganging band and blank therefor.

Another object of the present invention is to provide an improved wrap-around band and blank therefor which provides for a unitary saleable product composed of a plurality of individually sealed and complete packages which, after purchase, can be selectively opened on an as-needed basis without having to disturb the seal of the other individually complete package(s) of the unitary saleable product.

Another object of this invention is to provide an improved wrap-around band and blank therefor which avoids the need for processing and packaging equipment designed specifically for multiple-compartment packages bearing a particular mix of products and compartment shapes and sizes.

Another object of the present invention is to provide an improved multiple ganging band and blank therefor which allows for substantially unobstructed viewing of a plurality of protruding compartments filled with product to be purchased.

These and other objects, features and advantages of the present invention will be apparent from and clearly understood through a consideration of the following detailed description.

BRIEF DESCRIPTION OF THE DRAWINGS

In the course of this description, reference will be made to the attached drawings, wherein.

DESCRIPTION OF THE PREFERRED EMBODIMENTS

Figure 1:
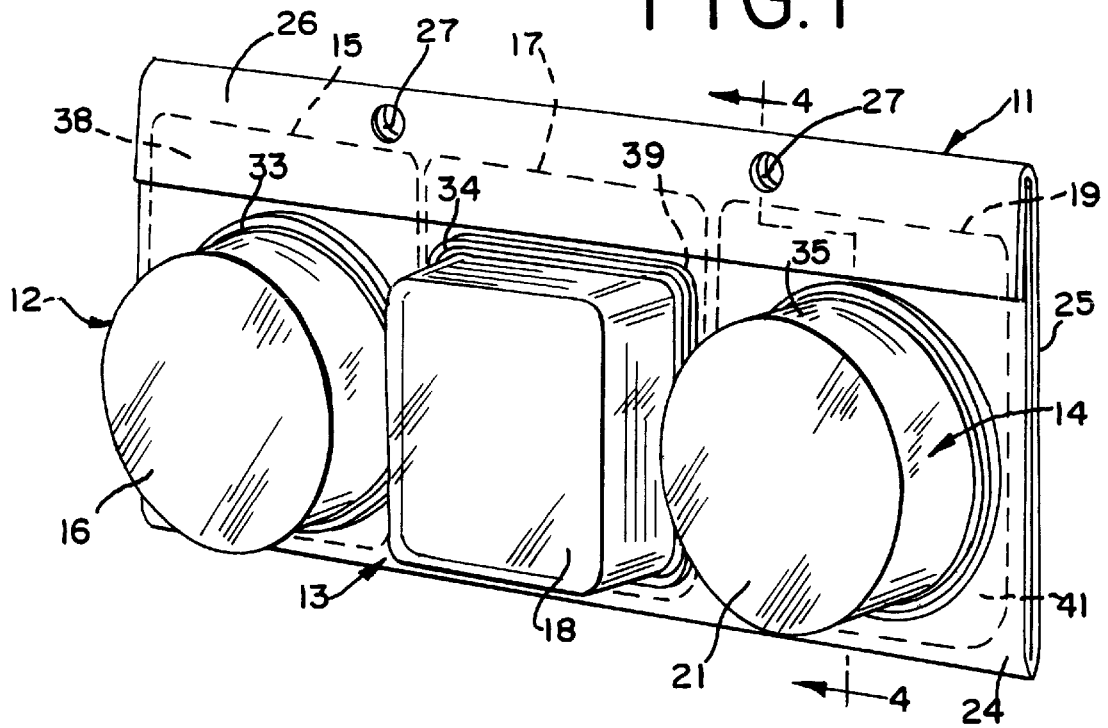
FIG. 1 is a perspective view of a particular embodiment of the ganging band wrapped around a plurality of different individually complete packages.

A wrap-around band is generally designated at 11 in FIG. 1. Wrap-around band 11 is shown in combination with a plurality of individually complete packages, generally designated at 12, 13 and 14. It will be appreciated that two or more individually complete packages, including more than three such packages, can be ganged together in accordance with the present invention. For purposes of simplicity of illustration, reference is made herein to three such individually complete packages.

With more particular reference to each illustrated individually complete package, the primary components of each are a base member and a product-receiving compartment protruding from the base member. Thus, package 12 includes base member 15 and protruding compartment 16. Package 13 includes base member 17 and protruding compartment 18. Package 14 includes base member 19 and protruding compartment 21. In a preferred package, the base member includes a pedestal component, described in greater detail elsewhere herein, the protruding compartment is a generally rigid upstanding bubble cavity, and a collar is defined by flanges of the base member and a bubble member including the protruding compartment.

Figure 2:
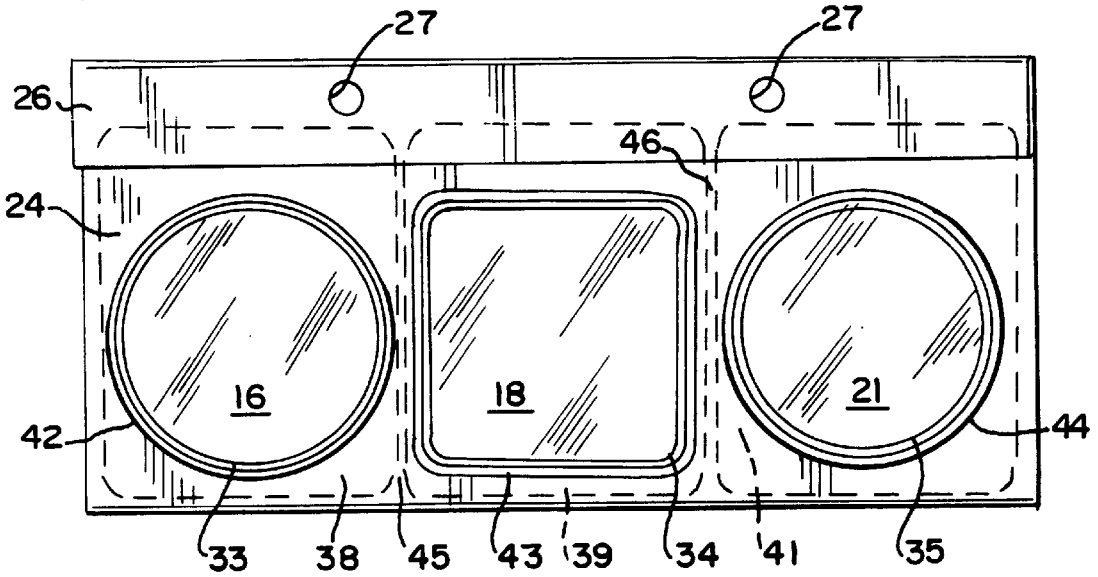
FIG. 2 is a top plan view of the combination shown in FIG. 1.

Concerning the illustrated wrap-around band 11 in greater detail, it includes a front portion 24 and a back portion 25 folded onto each other so as to form a sleeve. Suitable means are provided for joining together the front portion 24 and the back portion 25. In the illustrated embodiment, this takes the form of a tab or flap structure which may be termed a flap 26. The drawings illustrate the flap 26 to be visible from the outside of the wrap-around band 11. Such a flap or tab structure can instead be positioned inside of the sleeve forming the wrap-around band 11. The flap or tab structure need not continue for the full length of the sleeve, and the flap or tab structure can be provided at another location or locations, such as at the bottom edge or on the sides of the sleeve. The particular illustrated arrangement has certain advantages in that the flap 26, when positioned at the top portion of the wrap-around band (as illustrated in FIG. 1 and FIG. 2), provides added strength along that top portion. This added strength can be particularly beneficial when the unitary saleable product is intended to be hung or "peggable". In this regard, one or more peg-receiving holes 27 can be provided. The illustrated embodiment also provides excellent sealing opportunities in order to enhance the maintenance of the product as a unitary packaged product while also enhancing the tamper-resistant attributes of the wrap-around band.

Referring more particularly to the individually complete packages 12, 13 and 14, they can be, and preferably are, known packaged products which, in accordance with the present invention, are conveniently and efficiently ganged together. The invention is particularly well-suited for individually complete packages of sliced luncheon meat, cheeses and other similarly shaped products. Well-known in this regard are so-called bubble packages of sliced luncheon meat.

Figure 4:
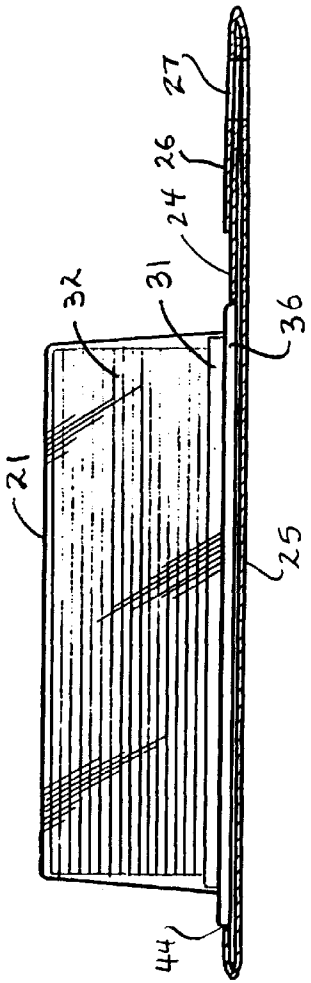
FIG. 4 is a cross-sectional view generally along the line 4—4 of FIG. 1.
Figure 3:
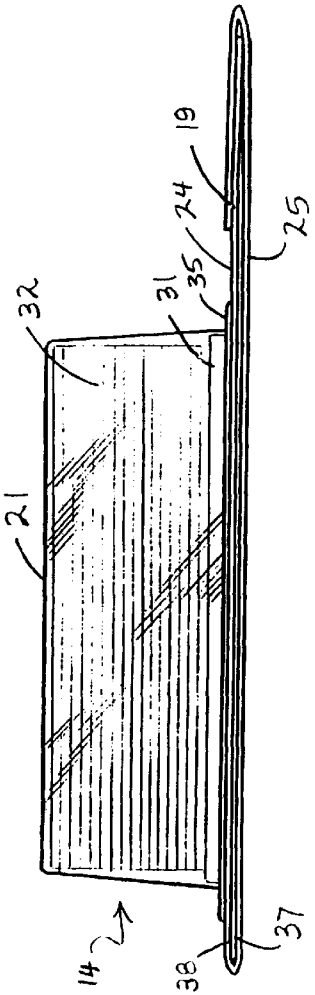
FIG. 3 is a side elevational view of the combination depicted in FIG. 1.

The base member 15, 17, 19 of the illustrated individually complete packages includes a pedestal 31, as can be seen in FIG. 3 and FIG. 4. In this illustrated embodiment, slices 32 of luncheon meat rest on top of this pedestal 31 (as viewed in FIG. 3 and FIG. 4). Thus, the slices 32 are sealed between the pedestal 31 and the protruding compartment or generally rigid upstanding bubble cavity 16, 18, 21.

Protruding compartment 16 and base member 15 are sealingly joined together in accordance with generally known approaches. The illustrated approach includes the provision of a peripheral channel 33, 34, 35 on the protruding compartment member. This peripheral channel receives a base member peripheral rail 36 (FIG. 4) so that the protruding compartment can be readily aligned with and closed onto the base member 15. If desired, suitable sealing lugs can be provided along the pedestal, and correspondingly shaped and sized sealing grooves (not shown) can be provided near the bottom of the bubble members 16, 18, 21. If needed, additional sealing or tamper-indicating features can be provided at or between peripheral flange portion 37 of base member or collar 19 and peripheral flange portion 38, 39, 41 of bubble member 16, 18, 21. These flange portions, in the illustrated embodiment, form the collar portion of each package.

In accordance with an important aspect of the invention, these collars of the individually complete packages 12, 13, 14 are substantially fully covered by the wrap-around band 11. This is perhaps best seen in FIG. 3 and FIG. 4.

Each front portion 24 of the wrap-around band is provided with a plurality of openings 42, 43, 44. It will be noted that each opening is sized and shaped to closely accommodate the respective individually complete package which is to be passed through the opening during assembly of the combined wrap-around band and plurality of individually complete packages. In the illustrated arrangement, each opening is sized and shaped to provide a periphery which engages or is closely adjacent to the peripheral channel 33, 34, 35 of the bubble member 16, 18, 21. In other possible embodiments, where there is no peripheral channel for example, the openings can be individually sized, shaped and positioned to engage or be closely adjacent to each protruding compartment or each bubble member.

With these types of arrangements, the individually complete packages 12, 13, 14, after the band 11 is wrapped around same and sealed, is securely positioned within the wrap-around band, with its protruding compartment 16, 18, 21 being fully visible and substantially uncovered by the wrap-around band. This approach is, of course, carried out for each of the plurality of individually complete packages which are desired to be assembled into the combination of the invention.

Referring more particularly to the positioning or placement of the plurality of openings 42, 43, 44, reference is made to FIG. 1 and especially to FIG. 2. Particular reference is made to the spacing between the respective collar portions of the individually complete packages (made up of flange 38, 39, 41 of the bubble member and the corresponding flange 37 of the base member in the illustrated embodiment). The spacings between the openings 42, 43, 44 of the wrap-around band are selected such that these respective flanges engage one another or are closely adjacent to one another, for example at 45 and 46. This allows the multiple individually complete packages to be ganged together by the wrap-around band while avoiding overlap between the respective flanges or collar portions of adjoining packages. To the extent that the respective flanges or collar portions of adjacent packages engage one another, this engagement can help to impart added stiffness or rigidity to the overall combination of packages within the wrap-around band.

The illustrated wrap-around band has an overall generally rectangular configuration. Thus, its front area and back area are each generally rectangular. Other configurations and shapes are possible. For example, front area and back area can be of a curved periphery, such as circular, oval or elliptical, or the periphery can be partially curved and partially straight-edged. Novelty shapes can be employed, such as those having sports motifs or having profiles representing cooking themes or food shapes. An illustrative curved peripheral profile is shown at phantom line 61 of FIG. 5.

Figure 5:
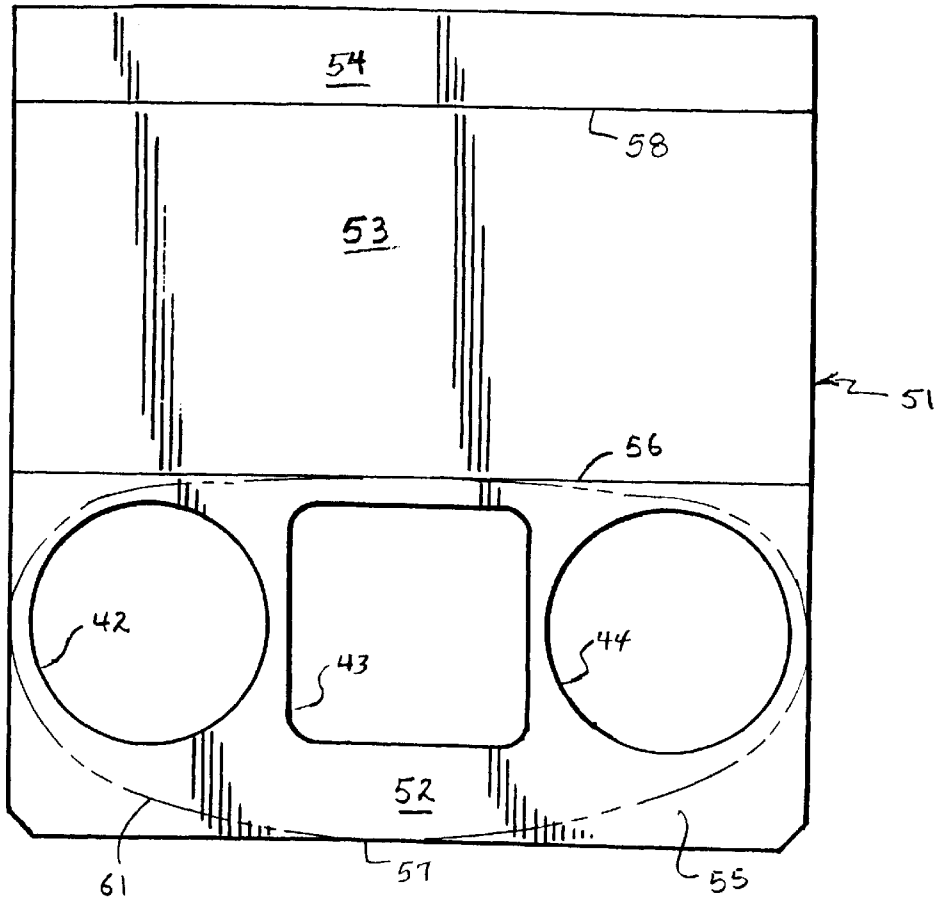
FIG. 5 is a plan view of a blank from which the ganging band depicted in FIG. 1 can be assembled.

A blank 51 out of which the illustrated wrap-around band 11 can be made is illustrated in FIG. 5. Blank 51 includes a front area 52 and a back area 53. A tab area 54 is also shown. Front area 52 contains the plurality of openings 42, 43, 44. The remainder of the front area defines a peripheral area 55, which is provided for engaging flanges 38, 39, 41 of the individually complete packages when the blank is formed into the wrap-around band as generally shown in FIG. 1.

A fold line 56 is provided at a location common to a first side edge of the back area 53 and a second side edge of the front area 52. A first side edge 57 of the front area 52 is positioned for general alignment with a second side edge 58 of the back area 53. In the illustrated embodiment, this second side edge 58 coincides with a fold line between the back area 53 and the tab area 54. It will be appreciated that additional features such as holes 27 (not shown in FIG. 5) can be incorporated into the blank 51.

Blank 51 is made of a foldable material, which can be polymeric or cellulosic. Preferably, the blank is made of paperboard material. Whatever the material, it should have enough strength and stiffness to be able to comfortably support the plurality of individually complete packages when the blank is formed into the band closely wrapped around the packages.

In forming the illustrated combination of band and packages, each package is positioned behind the front area 52 such that their respective protruding compartments 16, 18, 21 pass through the respective openings 42, 43, 44. At this stage, the protruding compartments are oriented out of the page as illustrated in FIG. 5, and their respective flanges 38, 39, 41 are generally obscured from view and covered by the peripheral area 55. Then, the back area 53 is brought into engagement with the back side of the packages 12, 13, 14, this being accomplished, for example, by bending the blank along fold line 56. Tab area 54, or other suitably provided flap or tab is brought into position, such as by folding along second side edge 58 of the back area, and the wrap-around band assembly is 14 completed by sealing or otherwise attaching the tab area 54 (or other similar structure) to an adjoining surface of the blank, which is the peripheral area 55 in the illustrated embodiment. When the assembly of this illustrated embodiment is complete, the first side edge 57 of the front area will be in generally direct alignment with the second side edge 58 of the back area. It will be appreciated that, at this stage, each of the packages 12, 13, 14 is supported by and secured within and ganged together by the thus-formed wrap-around band.

Any variety of shapes of packages and bubbles can be accommodated. It is only necessary to size, shape and locate the openings in the blank so as to correspond with the desired combination of packages desired to make up the combination. Most of the profiles of these types of packages are either substantially circular or substantially rectangular, as shown in FIG. 1, although it will be appreciated that other profiles and bubble shapes can be accommodated as needed.

It will further be appreciated that the present invention provides an approach for accommodating packages of various sizes for purchase as a single unit. The invention also provides for secure holding of multiple packages, which may be different sizes and shapes, as one purchasable unit. The wrap-around band provides means for providing evidence of tampering inasmuch as one cannot remove any of the products without tearing the wrap-around band. The wrap-around band also provides an additional level of protection for the primary seals which are typically provided by each of the individually complete packages. Space for promotional copy or graphics or for regulated or required copy or graphics is provided on the wrap-around band, which space is in addition to the space available on the individual packages themselves. Locations in this regard include the back portion and the peripheral area of the front portion of the band.

It will be understood that the embodiments of the present invention which have been described are illustrative of some of the applications of the principles of the present invention. Various modifications may be made by those skilled in the art without departing from the true spirit and scope of the invention.

I claim:

1. A ganged-together plurality of individually complete closed packages, comprising:

a plurality of individually complete closed packages, each said package having a collar portion, a compartment protruding from said collar portion, a closed bottom portion of said package adjacent said collar portion, each said individually complete closed package having saleable goods packaged within its protruding compartment and closed bottom portion;

a wrap-around band for ganging together in side-by-side orientation said plurality of individually complete closed packages;

a front surface of said wrap-around band, said front surface having a plurality of openings and a peripheral area around said openings, each said opening peripherally surrounding said closed bottom portion of each of said protruding compartments and in substantially unlocked relationship to said individually complete closed packages, their compartments, collar portions and closed bottom portions to permit unrestricted insertion and removal of each said individually complete closed package into and from its opening, said closed bottom portion being formed independently of said front surface of said wrap-around band to permit unrestricted removal of the individually complete closed packages from said front surface of said wrap-around band;

a back surface of said wrap-around band, said back surface being substantially free of openings and substantially covering said closed bottom portion of said individually complete closed packages opposite the side from which said compartment protrudes, said back surface, in cooperation with said peripheral area of the front surface, enclosing each said collar portion of the individually complete packages; and means for securing said peripheral area of the front surface to said back surface and for sealing each said collar portion, and thus each said plurality of individually complete closed packages within said wrap-around band and between said peripheral area of the front surface and said back surface of the wrap-around band.

2. The combination in accordance with claim 1, wherein at least one of said individually complete packages closed includes a peripheral channel and rail assembly by which the collar portion and protruding compartment are secured together, said channel and rail assembly being external of the protruding compartment, and at least a portion of said opening is engaged by said channel and rail assembly.

3. The combination in accordance with claim 1, wherein at least two of said individually complete closed packages are in edge-to-edge engagement with each other at a location within the wrap-around band.

4. The combination in accordance with claim 1, wherein said means for securing includes a flap member protruding from one of said front surface and back surface and sealed to the other of said front surface and back surface.

5. The combination in accordance with claim 1, wherein substantially all of said protruding compartment is outside of said wrap-around band.

6. The combination in accordance with claim 1, wherein said peripheral area of the front surface engages a front portion of said collar portion of each of said individually complete closed packages, and wherein said back surface of the wrap-around band engages a back surface of said collar portion.

7. The combination in accordance with claim 1, further including at least one hole within said wrap-around band, said hole being adapted to engage and cooperate with a member for suspending the ganged-together plurality of individually complete packages.

8. The combination in accordance with claim 1, wherein said saleable goods are food products, and the individually complete closed packages are hermetically sealed.

9. The combination in accordance with claim 1, wherein said saleable goods are stacked sliced products.

10. The combination in accordance with claim 1, wherein at least two of said individually complete closed packages have protruding compartment profiles which are different from each other.

11. The combination in accordance with claim 1, wherein at least one of said individually complete closed packages includes a base member and a bubble member including said protruding compartment, and at least one flange of at least one of said base member and bubble member generally defines said collar portion of the package.

12. The combination in accordance with claim 1, wherein at least one of said front surface or said back surface of the wrap-around band has a peripheral profile which is generally rectangular.

13. The combination in accordance with claim 1, wherein at least one of said front surface or said back surface of the wrap-around band has a peripheral profile which is at least partially curved.

14. The combination in accordance with claim 1, wherein at least one of said front surface or said back surface of the wrap-around band has a peripheral profile which is at least partially straight-edged.

15. The combination in accordance with claim 1, wherein said back surface of said wrap-around band covers said closed bottom portion of said individually complete closed packages in unfixed relationship thereto to permit unrestricted removal of said individually complete closed packages from said back surface.

* * * * *

UNITED STATES PATENT AND TRADEMARK OFFICE

CERTIFICATE OF CORRECTION

PATENT NO : 6,053,320

DATED : April 25, 2000

INVENTOR(S) : David F. Kuethe

It is certified that error appears in the above-identified patent and that said Letters Patent are hereby corrected as shown below:

Col. 1, line 11, delete "openings" and insert --Openings--.
Col. 5, line 48, "is 14" should read --14 is--.
Col. 6, line 66, "complete packages closed" should read --complete closed packages--.

Signed and Sealed this

Tenth Day of April, 2001

*Attest:*

Nicholas P. Godici

NICHOLAS P. GODICI

*Attesting Officer*

*Acting Director of the United States Patent and Trademark Office*